US006802708B2

(12) United States Patent
Kanzaki et al.

(10) Patent No.: US 6,802,708 B2
(45) Date of Patent: Oct. 12, 2004

(54) HIGH FREQUENCY HEATING APPARATUS

(75) Inventors: Kouji Kanzaki, Yamatokoriyama (JP); Yuji Hayakawa, Shiki-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/453,978

(22) Filed: Jun. 4, 2003

(65) Prior Publication Data

US 2004/0053187 A1 Mar. 18, 2004

(30) Foreign Application Priority Data

Jun. 5, 2002 (JP) ..... P. 2002-163943

(51) Int. Cl.[7] ..... H05B 6/64
(52) U.S. Cl. ..... 432/91; 219/682
(58) Field of Search ..... 122/36, 37, 20 R; 219/682, 710, 711, 731, 756; 432/91

(56) References Cited

U.S. PATENT DOCUMENTS 3,968,787 A * 7/1976 Basiulis ..... 126/351.1
4,449,026 A * 5/1984 Satoh ..... 219/682
4,497,406 A * 2/1985 Takanashi ..... 206/438
6,028,297 A * 2/2000 Hamada et al. ..... 219/625
6,229,131 B1 * 5/2001 Koochaki ..... 219/731
6,323,473 B1 * 11/2001 Yamamoto et al. ..... 219/771
6,528,774 B2 * 3/2003 Lee ..... 219/757

FOREIGN PATENT DOCUMENTS

JP 54-115448 9/1979
JP 10-78224 3/1998

* cited by examiner

*Primary Examiner*—Gregory Wilson
(74) *Attorney, Agent, or Firm*—Pearne & Gordon LLP

(57) ABSTRACT

A high frequency heating apparatus with steam generation function for supplying at least any one of high frequency and steam to a heating chamber 11 for accommodating an object to be heated and heat-treating the object to be heated, the apparatus has a high frequency generating part 13, a steam generating part 15 for generating steam inside the heating chamber 11, and a temperature detecting part 20 for detecting temperature of the steam generating part. Additionally, the steam generating part 15 generates steam by heating an evaporating dish 35 having a recess for containing water and a projecting surface 36.

15 Claims, 6 Drawing Sheets

HIGH FREQUENCY HEATING APPARATUS

BACKGROUND OF THE INVENTION

The present invention relates to a high frequency heating apparatus with steam generation function in which high frequency heating and steam heating are combined to heat-treat an object to be heated.

Conventionally, in this type of high frequency heating apparatus, there are a microwave oven with a high frequency generator for heating, and a combination oven that a convection heater for generating heated air is added in this microwave oven. In addition, a steamer that steam is introduced into a heating chamber and a steam convection oven that a convection heater is added in a steamer are also used as cooking appliances.

When food is cooked by the cooking appliance, the cooking appliance is controlled so as to cook the food in the best condition. More specifically, the cooking of combining high frequency heating with hot air heating can be controlled by the combination oven, and the cooking of combining steam heating with hot air heating can be controlled by the steam convection oven. However, in the cooking of combining high frequency heating with steam heating, efforts are needed that food to be cooked is transferred between different cooking appliances in each of heat treatment. In order to solve the inconvenience, there is a cooking appliance that realizes high frequency heating, steam heating, and electric heating by a single appliance. This cooking appliance is disclosed in JP-A-54-115448.

However, according to the configuration of the publication, a vaporizing chamber for generating heated steam is embedded under a heating chamber, and water is supplied from a water storage tank at a fixed water level all the time. Therefore, it is difficult to clean the periphery of the heating chamber everyday. A problem arises particularly in the vaporizing chamber that calcium and magnesium in water are concentrated to precipitate and fix onto the bottom of the vaporizing chamber or the inside of pipes to reduce an amount of steam generated in the course of generating steam, and consequently the chamber is turned to dirty environment where mold is easily propagated.

In addition, as a system for introducing steam into the heating chamber, it can be considered that steam is generated by a heating unit such as a boiler disposed outside the heating chamber and the steam generated here is supplied to the heating chamber. However, problems arise that mold is contaminated and propagated in a pipe for introducing steam, the pipe for introducing steam is damaged by freezing, and foreign substances such as rust are mixed. Furthermore, the heating unit is often difficult to be disassembled and cleaned. Therefore, in the cooking appliances that particularly require the attention to the hygiene of food to be treated, the system for introducing steam from outside is hard to adopt.

SUMMARY OF THE INVENTION

The invention has been made in consideration of the circumstances. An object is to provide a high frequency heating apparatus with steam generation function in which a steam generating part is easy to clean and can be kept hygienically, and the temperature of the steam generating part is controlled to generate an optimum amount of steam for foods for enhancing heating efficiency.

In order to achieve the object, a high frequency heating apparatus according to the invention has a high frequency generating part, a steam generating part for generating steam inside a heating chamber, and a temperature detecting part for detecting temperature of the steam generating part Accordingly, steam can be supplied into the heating chamber quickly to enhance the efficiency of generating steam, and a rate of temperature rise in an object to be heated can be accelerated by combining high frequency heating with steam heating. Therefore, efficient cooking is feasible for a short time.

An aspect of the high frequency heating apparatus with steam generation function comprises: a high frequency generating part for supplying a high frequency to a heating chamber for accommodating an object to be heated; and a steam generating part for generating steam inside the heating chamber, wherein at least any one of high frequency and steam is supplied into the heating chamber to heat-treat the object to be heated, the high frequency heating apparatus including a temperature detecting part for detecting temperature of the steam generating part.

In the high frequency heating apparatus with steam generation function, since steam is generated inside the heating chamber, the steam can be supplied into the heating chamber quickly, and the efficiency of generating steam can be improved. In addition, since the steam generating part exists inside the heating chamber, the steam generating part can be cleaned easily at the same time when the inside of the heating chamber is cleaned, and the inside of the heating chamber can be kept in a hygienic environment all the time. Furthermore, since the apparatus has the temperature detecting part for detecting the temperature of the steam generating part, heating without water can be prevented, and safety can be enhanced. Moreover, as the heating systems, both of high frequency heating and steam heating can be performed at the same time, either high frequency heating or steam heating can be performed separately, and both can be performed in a predetermined order freely. Thus, a suitable cooking method can be selected freely in accordance with types of foods, frozen foods and refrigerated foods. Particularly, since a rate of temperature rise in the object to be heated can be accelerated when high frequency heating and steam heating are used in combination, efficient cooking is feasible for a short time.

Another aspect of the high frequency heating apparatus with steam generation function is characterized by having a high frequency generating part for supplying a high frequency to a heating chamber for accommodating an object to be heated; and a steam generating part for generating steam inside the heating chamber, wherein at least any one of high frequency and steam is supplied into the heating chamber to heat-treat the object to be heated, wherein the steam generating part has a temperature detecting part for detecting temperature of the steam generating part near an evaporating dish having a recess for containing water to generate steam by heating.

In the high frequency heating apparatus with steam generation function, since the temperature detecting part is disposed near the evaporating dish for generating steam, the temperatures of the evaporating dish can be controlled more minutely, and an amount of steam generated can be controlled optimally in accordance with foods.

A further aspect of the high frequency heating apparatus with steam generation function is characterized in that the temperature detecting part has a temperature detecting unit disposed outside the reflector for reflecting radiant heat from an evaporating dish heater for heating the evaporating dish toward the evaporating dish.

In the high frequency heating apparatus with steam generation function, the evaporating dish is heated by the evaporating dish heater to generate steam, and the radiant heat from the evaporating dish heater is reflected toward the evaporating dish by the reflector. Therefore, the heat generated by the heater can be utilized to generate steam highly efficiently. Additionally, since the temperature detecting part is disposed outside the reflector, the temperatures of the evaporating dish can be detected with no influence of the radiant heat from the heater, and an amount of steam generated can be controlled in accordance with foods.

A still another aspect of the high frequency heating apparatus with steam generation function is characterized in that the evaporating dish has a projecting surface in a part of the recess for containing water.

In the high frequency heating apparatus with steam generation function, the evaporating dish is disposed inside the heating chamber, and water stored in the recess for containing water in the evaporating dish is heated to generate steam. The projecting surface is disposed in a part of the recess for containing water, the projecting surface is exposed when the amount of water is reduced, and the temperatures of the projecting surface partially rise. Therefore, the temperature detecting part can detect an amount of water left before water in the evaporating dish is completely evaporated, and an amount of steam generated can be controlled in accordance with foods.

A yet another aspect of the high frequency heating apparatus with steam generation function is characterized in that the projecting surface in the evaporating dish is continuously disposed from the inner side to the outer side of the reflector, and the temperature detecting unit is disposed at the projecting surface.

In the high frequency heating apparatus with steam generation function, the evaporating dish is disposed inside the heating chamber, and water stored in the recess for containing water in the evaporating dish is heated to generate steam. Since the projecting surface is formed in a part of the recess for containing water to the outside of the reflector, when the amount of water is reduced and the projecting surface is exposed to raise the temperature, heat is easily transferred to the temperature detecting part disposed outside the reflector, and an amount of steam generated can be controlled more minutely.

A still further aspect of the high frequency heating apparatus with steam generation function is characterized in that a plurality of the temperature detecting parts is disposed near the evaporating dish.

In the high frequency heating apparatus with steam generation function, the plurality of the temperature detecting parts is disposed near the evaporating dish for generating steam inside the heating chamber. Therefore, temperatures can be detected accurately even though the evaporating dish has variations in the temperature distribution, and the reliability of control can be enhanced.

A yet another aspect of the high frequency heating apparatus with steam generation function is characterized in that at least one of the plurality of the temperature detecting parts is disposed near a water supply part for supplying water into the evaporating dish.

In the high frequency heating apparatus with steam generation function, the plurality of the temperature detecting parts is disposed near the evaporating dish for generating steam inside the heating chamber, and at least one of the temperature detecting parts is disposed near the water supply part for supplying water into the evaporating dish, which can detect the new supply of water into the evaporating dish when new water is supplied to reduce temperatures near the temperature detecting part.

A yet further aspect of the high frequency heating apparatus with steam generation function is characterized in that the plurality of the temperature detecting parts is disposed at projecting surfaces having different heights provided in the evaporating dish.

In the high frequency heating apparatus with steam generation function, the plurality of the temperature detecting parts is disposed near the evaporating dish for generating steam inside the heating chamber, and they are disposed at each of the projecting surfaces having different heights disposed in the evaporating dish. Therefore, the level of water left in the evaporating dish can be detected because the water level of each of the projecting surfaces exposed is varied.

A still yet another aspect of the high frequency heating apparatus with steam generation function is characterized in that the evaporating dish is formed of the same material as that of the heating chamber.

In the high frequency heating apparatus with steam generation function, the evaporating dish for generating steam inside the heating chamber is formed of the same material as that of the heating chamber, which can prevent electrolytic corrosion by contact of dissimilar metals. Additionally, the evaporating dish can be formed by denting a part of the bottom of the heating chamber downward.

A yet another aspect of the high frequency heating apparatus with steam generation function is characterized in that the evaporating dish has the surface of the recess for containing water surface-treated with fluorine.

In the high frequency heating apparatus with steam generation function, since the recess for containing water in the evaporating dish for generating steam inside the heating chamber is surface-treated with fluorine, the evaporating dish can be cleaned easily. That is, calcium and magnesium in water are sometimes concentrated to precipitate and fix onto the bottom of the evaporating dish in the course of generating steam. However, since the surface treatment with fluorine allows easy wiping, the environment of the heating chamber can be kept hygienically all the time.

A still yet further aspect of the high frequency heating apparatus with steam generation function is characterized in that the evaporating dish has a surface formed of a color having a heat absorption rate different from a material color, the surface onto which radiant heat is irradiated from the evaporating dish heater.

In the high frequency heating apparatus with steam generation function, the radiant heat from the evaporating dish heater is reflected toward the evaporating dish by the reflector. Additionally, the surface onto which the radiant heat from the evaporating dish is irradiated is formed of the color having a high heat absorption rate, which allows the heat generated by the heater to be utilized for generating steam highly efficiently.

DETAILED DESCRIPTION OF THE DRAWINGS

Hereafter, preferred embodiments of the high frequency heating apparatus with steam generation function according to the invention will be described in detail with reference to the drawings.

First Embodiment

Figure 1:
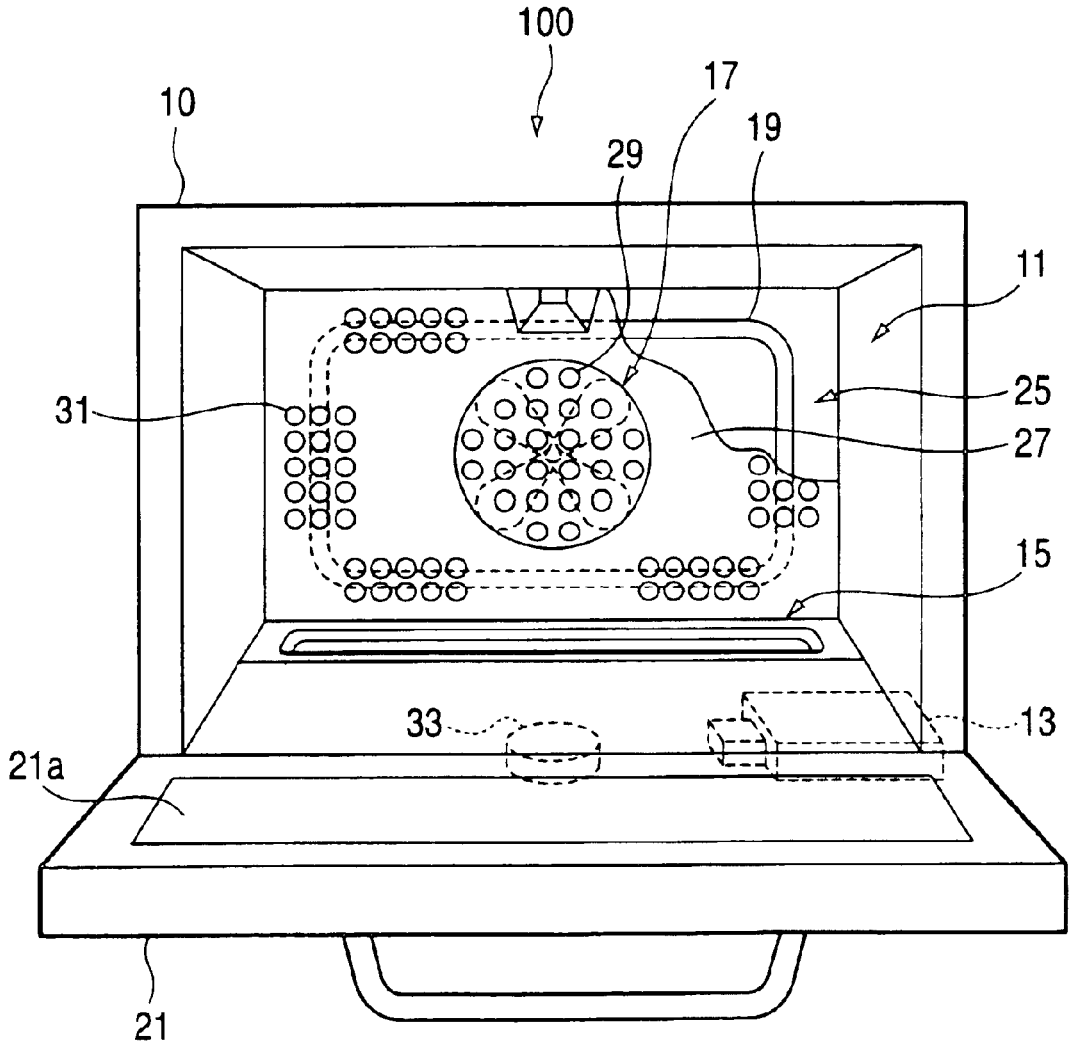
FIG. 1 is a front view illustrating a high frequency heating apparatus with steam generation function of a first embodiment according to the invention, in which its door is opened.
Figure 2:
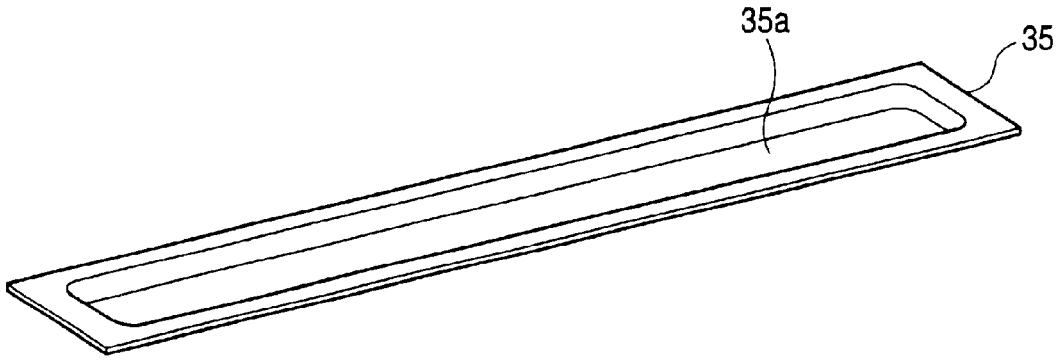
FIG. 2 is a perspective view illustrating an evaporating dish of a steam generating part used in the high frequency heating apparatus with steam generation function shown in FIG. 1.
Figure 3:
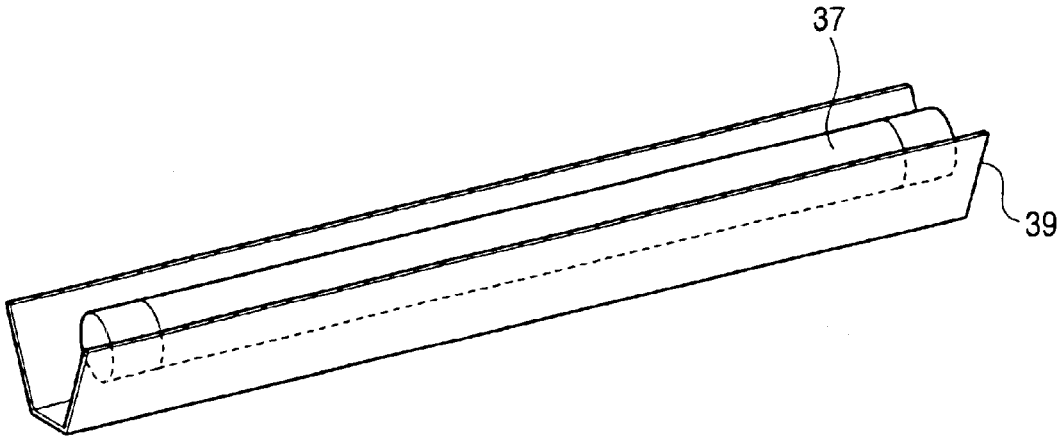
FIG. 3 is a perspective view illustrating an evaporating dish heater and a reflector of the steam generating part.
Figure 4:
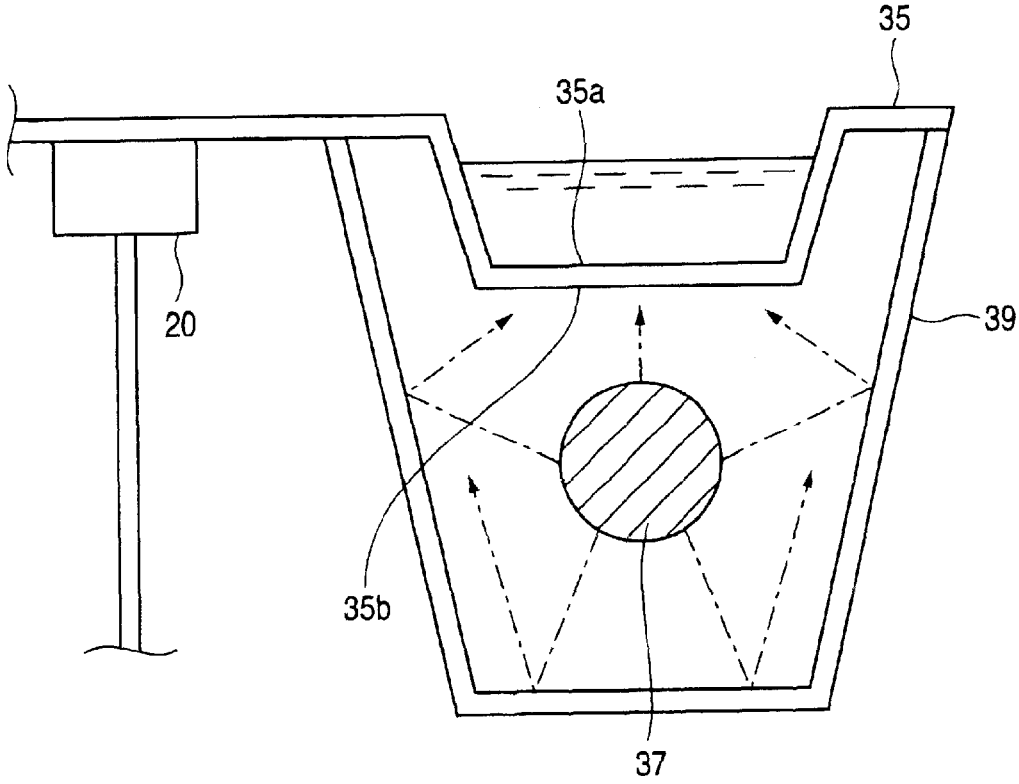
FIG. 4 is a cross-sectional view of the steam generating part in the same apparatus.

FIG. 1 is a front view illustrating a high frequency heating apparatus with steam generation function of a first embodiment, in which its door is opened. FIG. 2 is a perspective view illustrating an evaporating dish of a steam generating part used in the apparatus, FIG. 3 is a perspective view illustrating an evaporating dish heater and a reflector of the steam generating part, and FIG. 4 is a cross-sectional view of the steam generating part.

This high frequency heating apparatus with steam generation function 100 is a cooking appliance in which a heating chamber 11 for accommodating an object to be heated is supplied with at least any one of a high frequency (microwave) and steam and the object to be heated is heat-treated. The apparatus has a magnetron 13 as a high frequency generating part for generating a high frequency, a steam generating part 15 for generating steam inside the heating chamber 11, a circulation fan 17 for stirring and circulating air inside the heating chamber 11, and a convection heater 19 as a heater for heating air inside the heating chamber 11.

The heating chamber 11 is formed inside a box-shaped main case 10, and a door 21 with a translucent window 21*a* for opening and closing a drawing port for the object to be heated inside the heating chamber 11 is disposed in front of the main case 10. The door 21 is openable and closable in the vertical direction by being joined to the lower rim of the main case 10 by hinge. A predetermined heat insulation space is kept between the heating chamber 11 and the main case 10, and a heat insulator is filled in the space as required. Particularly, a space behind the heating chamber 11 is a circulation fan chamber 25 for housing the circulation fan 17 and its drive motor (not shown) therein, and a rear wall of the heating chamber 11 is a partition plate 27 for defining the heating chamber 11 from the circulation fan chamber 25. The partition plate 27 is disposed with air intake vent holes 29 for taking in air from the heating chamber 11 side to the circulation fan chamber 25 side, and air blowing vent holes 31 for blowing air from the circulation fan chamber 25 side to the heating chamber 11. Each of the vent holes 29 and 31 is formed as a plurality of punched The circulation fan 17 is disposed as the rotation canter is placed at the center part of the rectangular partition plate 27, and the rectangular ring-shaped convection heater 19 is disposed in the circulation fan chamber 25 as it surrounds the circulation fan 17. Then, the air intake vent holes 29 formed in the partition plate 27 are arranged in front of the circulation fan 17, and the air blowing vent holes 31 are arranged along the convection heater 19. When the circulation fan 17 is rotated, winds are set to blow from the front side of the circulation fan 17 to the rear side where the drive motor is disposed. Thus, air inside the heating chamber 11 is taken in the center part of the circulation fan 17 through the air intake vent holes 29, and it is sent from the air blowing vent holes 31 into the heating chamber 11 through the convection heater 19 inside the circulation fan chamber 25. Therefore, the air inside the heating chamber 11 is circulated by this blow through the circulation fan chamber 25 as the air is stirred.

The magnetron 13 is disposed in the space under the heating chamber 11, for example, and a stirrer 33 is disposed at the position receiving a high frequency generated from the magnetron. Then, the high frequency from the magnetron 13 is irradiated onto the stirrer 33 rotating to supply the high frequency into the heating chamber 11 by the stirrer 33 as the high frequency is stirred. In addition, the magnetron 13 and the stirrer 33 can be disposed not only on the bottom of the heating chamber 11 but also on the top or side of the heating chamber 11.

The steam generating part 15 is configured of an evaporating dish 35 having a recess 35*a* for containing water to generate steam by heating as shown in FIG. 2, an evaporating dish heater 37 disposed under the evaporating dish 35 for heating the evaporating dish 35 as shown in FIGS. 3 and 4, and a reflector 39 having a nearly U-shape in cross section for reflecting radiant heat from the heater toward the evaporating dish 35. A temperature detecting part 20 is disposed under the evaporating dish 35 and outside the reflector 39. The evaporating dish 35 is a long slender plate made of metal, which is disposed so that its longitudinal side is oriented along the partition plate 27 for defining the heating chamber 11 from the circulation fan chamber 25 in the rear bottom surface on the opposite side of the drawing port for the object to be heated inside the heating chamber 11. The evaporating dish 35 is formed of the same material as that of the bottom of the heating chamber, in which the surface of the recess 35*a* for containing water for generating steam is surface-treated with fluorine. Furthermore, a backside 35*b* of the recess 35*a* for containing water is processed with a color having a high heat absorption rate different from a material color such as black. Moreover, as the evaporating dish heater 37, a glass tube heater, a sheathed heater, and a plate-heater are usable.

As described above, according to the high frequency heating apparatus with steam generation function, since it is configured to generate steam inside the heating chamber 11, not outside, the portion of generating steam, that is, the evaporating dish 35 can be cleaned easily as similar to the case of cleaning the inside of the heating chamber 11. For example, calcium, magnesium, and chlorine compound in water are sometimes concentrated to precipitate and fix on to the bottom of the evaporating dish 35 in the course of generating steam, but those fixed onto the surface of the evaporating dish 35 can be removed cleanly only by wiping them with cloth. In addition, since the surface of the evaporating dish 35 is surface-treated with fluorine, it is hard to be soiled and is easily wiped Therefore, the inside of the heating chamber 11 can be kept in a hygienic environment easily all the time.

Furthermore, in the high frequency heating apparatus, since the evaporating dish 35 is formed of the same material as that of the heating chamber 11, such a heating chamber can be configured as electrolytic corrosion by contact of dissimilar metals is hard to generated in the dish even though the dish is fixed to the other surface of the heating chamber by welding or swaging, corrosion is hard to generate even under a moisture-rich environment such as steam, the fixed part by welding is unlikely to be removed by corrosion to cause radio waves to be leaked outside the heating chamber, and sparks are less likely to be generated. Moreover, it is possible to form the evaporating dish 35 by punching out a part of the bottom of the heating chamber downward in order to reduce costs.

In addition, in the high frequency heating apparatus, since the evaporating dish 35 is heated by the evaporating dish heater 37 to generate steam, the steam can be supplied efficiently with a simple structure. Since steam at high temperature to some extent is generated, cooking simply steamed or cooking in combination with high frequency heating so as not to be dried is possible.

Furthermore, the radiant heat from the evaporating dish heater 37 is reflected toward the evaporating dish 35 by the ref lector 39 and the backside 35*b* of the recess 35*a* for containing water is processed with a color having a high heat absorption rate. Therefore, the heat generated by the evaporating dish heater 37 can be used for generating steam efficiently with no waste.

Moreover, as the heating methods, both of high frequency heating and steam heating can be performed at the same time, either high frequency heating or steam heating can be performed separately, and both can be performed in a predetermined order freely. Thus, a suitable cooking method can be selected freely in accordance with types of foods, frozen foods and refrigerated foods. Particularly, since a rate of temperature rise in the object to be heated can be accelerated when high frequency heating and steam heating are used in combination, efficient cooking is feasible.

Second Embodiment

Next, a high frequency heating apparatus with steam generation function of a second embodiment will be described with FIGS. 5 and 6. Additionally, in the description below, the same components as those in the first embodiment are designated the same numerals and signs for omitting the description.

Figure 5:
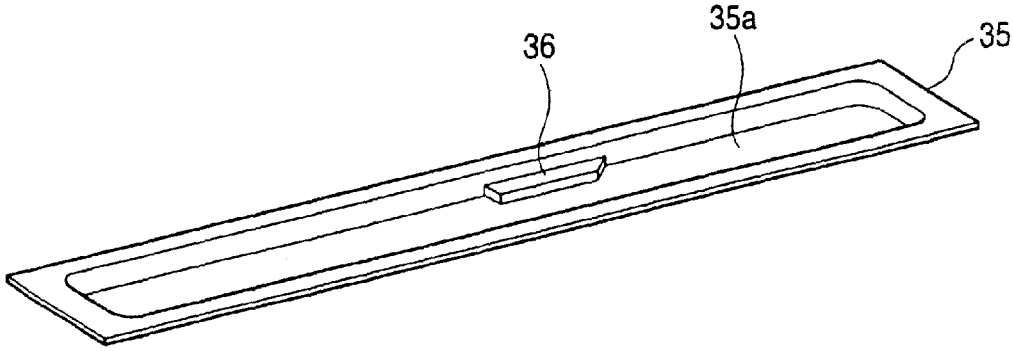
FIG. 5 is a perspective view illustrating an evaporating dish in a high frequency heating apparatus with steam generation function of a second embodiment according to the invention

The high frequency heating apparatus with steam generation function of the embodiment is characterized in that a projecting surface 36 is disposed in a recess 35*a* for containing water for generating steam in an evaporating dish 35, as shown in FIG. 5.

Figure 6:
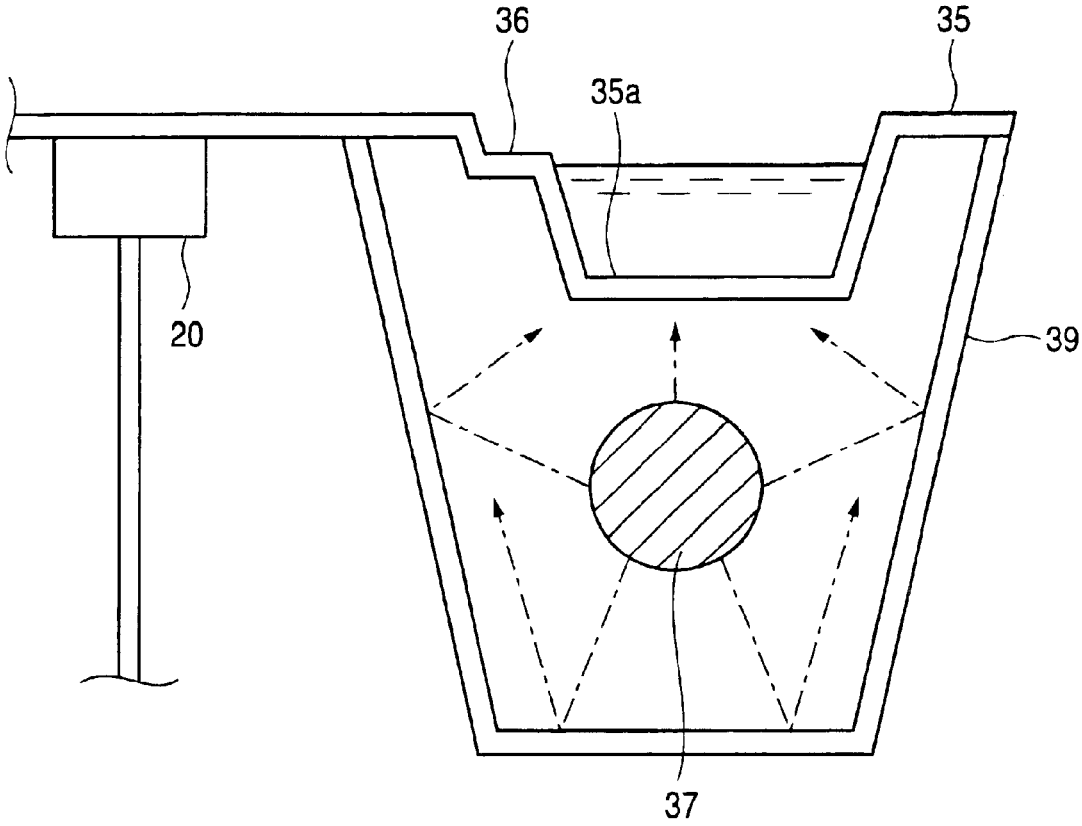
FIG. 6 is a cross-sectional view of a steam generating part in the same apparatus.

According to the embodiment, when water is supplied into in the evaporating dish 35 and then steam is generated to vary the water surface as shown in FIG. 6, the projecting surface 36 is exposed from the water surface as water is reduced. The recess 35*a* for containing water is heated by the evaporating dish heater 37, but the temperature becomes stable around at a temperature of 100° C. when water is left in the evaporating dish 35. However, since the projecting surface 36 is exposed from the water surface and heated by the evaporating dish heater 37, the temperature thereof rises at a temperature of 100° C. or greater. Since a temperature detecting part 20 is disposed under the evaporating dish 35*a* and outside a reflector 39, the part is not directly affected by the radiant heat from the evaporating dish heater 37 and can detect temperature variations in the projecting surface 36.

According to the configuration, the temperature detecting part 20 can detect an amount of water left before water in the evaporating dish is less completely evaporated than that in the embodiment described above, heating without water can be prevented, and an amount of steam generated can be controlled in accordance with foods.

Third Embodiment

A high frequency heating apparatus with steam generation function of a third embodiment will be described with FIG. 7

Figure 7:
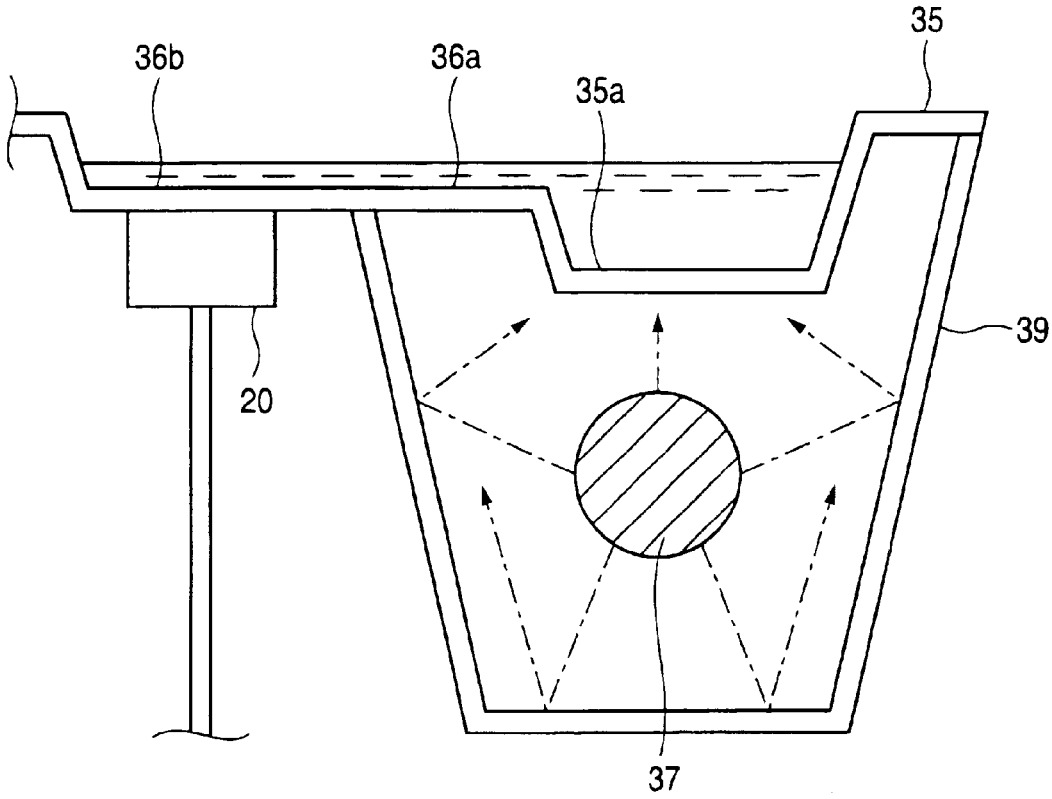
FIG. 7 is a cross-sectional view of an evaporating dish of a high frequency heating apparatus with steam generation function in a third embodiment according to the invention.

The high frequency heating apparatus with steam generation function of the embodiment is characterized in that a projecting surface 36 disposed in a recess 35*a* for containing water for generating steam in an evaporating dish 35 is continuously disposed from the inner side to the outer side of the reflector and a temperature detecting part 20 is disposed at a projecting surface 36*b*, as shown in FIG. 7.

According to the embodiment, a projecting surface 36*a* is under water surface when water is supplied into the evaporating dish 35, but the projecting surface 36*b* where the temperature detecting part 20 is disposed is also under water surface at the same time. When water surface is varied by generating steam, the projecting surfaces 36*a* and 36*b* are exposed from the water surface and heated by an evaporating dish heater 37, and thus the temperature rises at a temperature of 100° C. or greater.

According to the configuration, since the surface itself where the temperature detecting part 20 is disposed is under water surface more than that in the embodiments described above, the temperature differences are great when the surface is exposed, the accuracy of detecting an amount of water left is enhanced, and more accurate control over an amount of steam generated is feasible.

Fourth Embodiment

Figure 9:
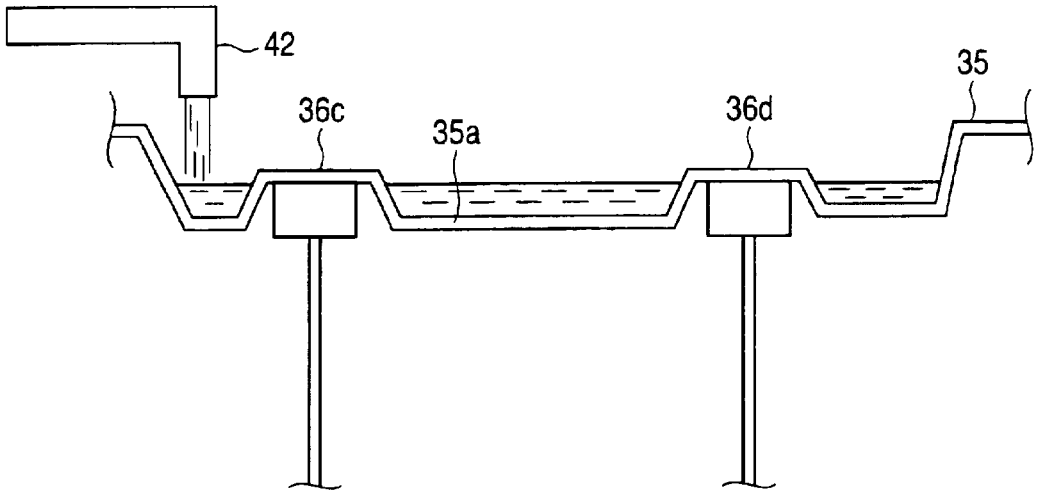
FIG. 9 is a cross-sectional view of a steam generating part provide with projecting surfaces near a water supply part of the same apparatus.
Figure 10:
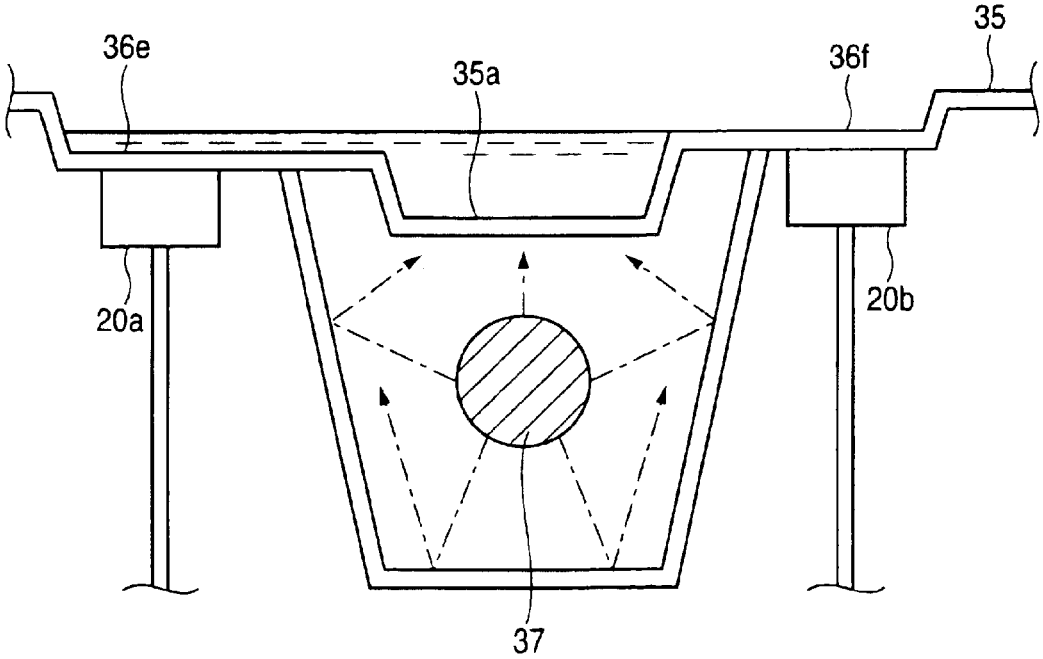
FIG. 10 is a cross-sectional view of a steam generating part having projecting surfaces with different heights in the same apparatus.

A high frequency heating apparatus with steam generation function of a fourth embodiment will be described with FIGS. 8, 9 and 10.

Figure 8:
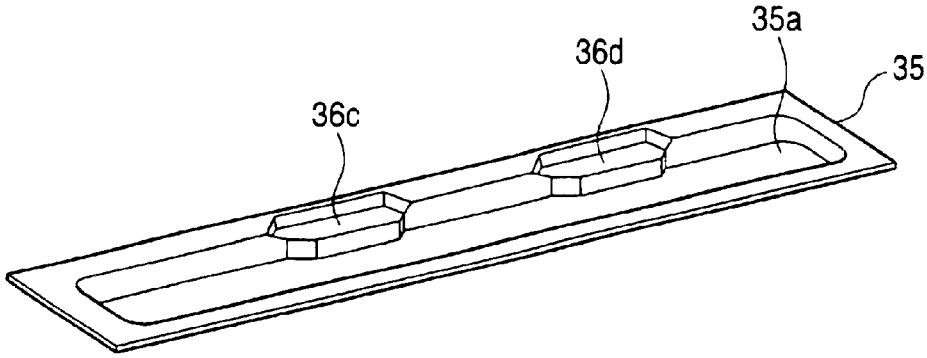
FIG. 8 is a perspective view illustrating an evaporating dish of a high frequency heating apparatus with steam generation function in a fourth embodiment according to the invention.

The high frequency heating apparatus with steam generation function is characterized in that a plurality of projecting surfaces 36*c* and 36*d* is disposed in a recess 35*a* for containing water for generating steam in an evaporating dish 35, as shown in FIG. 8.

According to the embodiment, the evaporating dish 35 is a long slender plate made of metal, which is disposed so that its longitudinal side is oriented along the partition plate 27 for defining the heating chamber 11 from the circulation fan chamber 25 in the rear bottom surface on the opposite side of the drawing port for the object to be heated inside the heating chamber 11. The shape of the evaporating dish 35 is necessarily a slender shape long from side to side. Consequently, temperature variations are generated in the evaporating dish 35 itself due to variations in the coil winding of an evaporating dish heater 37 or distribution variations in the surface tension of water. However, the plurality of the projecting surfaces 36*c* and 36*d* is disposed in the recess 35*a* for containing water and the temperature detecting part is disposed, which can reduce the influence of the temperature variations. In addition, as shown in FIG. 9, at least one of the plurality of the projecting surfaces is disposed near a water supply part 42 for supplying water into the evaporating dish 35, which can detect the new supply of water into the evaporating dish when new water is supplied to reduce temperatures near the projecting surface 36*c*. Furthermore, as shown in FIG. 10, when the height of a plurality of projecting surfaces 36*e* and 36*f* is changed, the water level where each of the projecting surfaces is exposed is varied. Therefore, the level of water left in the evaporating dish can be detected.

According to the configuration, a plurality of the temperature detecting parts is disposed near the evaporating dish for generating steam in the heating chamber more than those in the embodiments described above. Therefore, temperatures can be detected accurately even though the evaporating dish has variations in the temperature distribution, and the reliability of control can be enhanced. In addition, it is feasible to detect whether water is newly supplied and to detect the water level, the steam generation can be controlled more minutely, and safety in preventing the heating without water can be enhanced.

According to the high frequency heating apparatus with steam generation function in the invention, since steam is generated inside the heating chamber, the steam can be supplied into the heating chamber quickly, and the efficiency of generating steam can be improved. Additionally, since the steam generating part exists inside the heating chamber, the steam generating part can be cleaned easily at the same time when the inside of the heating chamber is cleaned, and the inside of the heating chamber can be kept on a hygienic environment all the time. Furthermore, as the heating systems, both of high frequency heating and steam heating can be performed at the same time, either high frequency heating or steam heating can be performed separately, and both can be performed in a predetermined order freely. Thus, a suitable cooking method can be selected freely in accordance with types of foods, frozen foods and refrigerated foods. Particularly, since a rate of temperature rise in the object to be heated can be accelerated when high frequency heating and steam heating are used in combination, efficient cooking is feasible for a short time.

What is claimed is:

1. A high frequency heating apparatus comprising:

a high frequency generating part for supplying a high frequency to a heating chamber for accommodating an object to be heated;

a steam generating part for generating steam inside the heating chamber; and a temperature detecting part for detecting temperature of the steam generating part, wherein at least one of high frequency and steam is supplied into the heating chamber to heat-treat the object to be heated, and temperature of the steam generating part is controlled to prevent heating without water and control an amount of steam generated.

2. The high frequency apparatus according to claim 1, wherein the steam generating part does not contact the object to be heated.

3. The high frequency apparatus according to claim 1, wherein the steam generating part is formed by a recess positioned in the bottom of the heating chamber.

4. The high frequency apparatus according to claim 3, wherein the steam generating part further comprises a heater.

5. The high frequency apparatus according to claim 4, wherein the heater is operable independently of the high frequency generating part.

6. A high frequency heating apparatus comprising:

a high frequency generating part for supplying a high frequency to a heating chamber for accommodating an object to be heated;

a steam generating part for generating steam inside the heating chamber; and a temperature detecting part for detecting temperature of the steam generating part near an evaporating dish having a recess for containing water to generate steam by heating, wherein at least any one of high frequency and steam is supplied into the heating chamber to heat-treat the object to be heated.

7. The high frequency heating apparatus according to claim 6, wherein the temperature detecting part has a temperature detecting unit disposed outside the reflector for reflecting radiant heat from an evaporating dish heater for heating the evaporating dish toward the evaporating dish.

8. The high frequency heating apparatus according to claim 6 or 7, wherein the evaporating dish has a projecting surface in a part of the recess for containing water.

9. The high frequency heating apparatus according to claim 8, wherein the projecting surface in the evaporating dish is continuously disposed from an inner side to an outer side of the reflector, and the temperature detecting unit is disposed at the projecting surface.

10. The high frequency heating apparatus according to claim 6 or 7, wherein a plurality of the temperature detecting parts is disposed near the evaporating dish.

11. The high frequency heating apparatus according to claim 10, wherein at least one of the plurality of the temperature detecting parts is disposed near a water supply part for supplying water into the evaporating dish.

12. The high frequency heating apparatus according to claim 10, wherein the plurality of the temperature detecting parts is disposed at projecting surfaces having different heights provided in the evaporating dish.

13. The high frequency heating apparatus according to any one of claim 6 or 7, wherein the evaporating dish is formed of a same material as that of the heating chamber.

14. The high frequency heating apparatus according to claim 13, wherein the evaporating dish has a surface of the recess for containing water surface-treated with fluorine.

15. The high frequency heating apparatus according to claim 13, wherein the evaporating dish has a surface formed of a color having a heat absorption rate different from a material color, the surface onto which radiant heat is irradiated from the evaporating dish heater.

* * * * *